US008117680B1

(12) United States Patent
Chou

(10) Patent No.: US 8,117,680 B1
(45) Date of Patent: Feb. 21, 2012

(54) SWIMMING GOGGLES BUCKLE

(75) Inventor: Shu-Fang Chou, Taipei Hsien (TW)

(73) Assignee: First Rank Co., Ltd., Taipei Hsien (TW)

( * ) Notice: Subject to any disclaimer, the term of this patent is extended or adjusted under 35 U.S.C. 154(b) by 76 days.

(21) Appl. No.: 12/859,536

(22) Filed: Aug. 19, 2010

(51) Int. Cl.
*A61F 9/02* (2006.01)

(52) U.S. Cl. ..... 2/450; 2/452; 24/170

(58) Field of Classification Search ..... 2/450, 452, 2/439, 440, 445, 448; 24/170, 191, 193
See application file for complete search history.

(56) References Cited

U.S. PATENT DOCUMENTS

| | | | | |
|---|---|---|---|---|
| 6,832,394 | B1 * | 12/2004 | Chiang | 2/428 |
| 6,961,965 | B2 * | 11/2005 | Chiang | 2/445 |
| 7,007,311 | B2 * | 3/2006 | Chiang | 2/448 |
| 7,020,905 | B2 * | 4/2006 | Chiang | 2/448 |
| 7,100,215 | B2 * | 9/2006 | Shiue | 2/443 |
| 7,146,653 | B2 * | 12/2006 | Chou | 2/426 |
| 7,251,842 | B1 * | 8/2007 | Chiang | 2/445 |
| 7,647,650 | B2 * | 1/2010 | Chiang | 2/431 |
| 7,698,751 | B2 * | 4/2010 | Chiang | 2/450 |
| 7,810,175 | B2 * | 10/2010 | Chiang | 2/448 |
| 7,856,674 | B2 * | 12/2010 | Chou | 2/452 |
| 7,921,523 | B2 * | 4/2011 | Chou | 24/170 |
| 8,042,199 | B2 * | 10/2011 | Chiang | 2/448 |
| 2006/0059607 | A1 * | 3/2006 | Chiang | 2/428 |
| 2007/0186332 | A1 * | 8/2007 | Chiang | 2/448 |

* cited by examiner

*Primary Examiner* — Danny Worrell
(74) *Attorney, Agent, or Firm* — Rosenberg, Klein & Lee

(57) ABSTRACT

A swimming goggles buckle is latched to a head strap and swimming goggles. The head strap includes protruding strips. The swimming goggles buckle includes a fastener and a retaining component. The fastener includes connecting legs, a pivot portion and an elastic plate. The connecting legs latch the swimming goggles. The pivot portion is at the middle of the fastener. The elastic plate is installed on a side of the fastener. The retaining component includes a shaft, a latching portion and a press portion. The shaft is pivotally installed in the pivot portion. The latching portion is on a side of the shaft and corresponding to the protruding strips. The press portion is on another side of the shaft and corresponding to the elastic plate. The press portion is pressed to separate the latching portion or latch the protruding strips to adjust the length of the head strap by one hand.

8 Claims, 7 Drawing Sheets

2

SWIMMING GOGGLES BUCKLE

BACKGROUND OF THE INVENTION

1. Field of the Invention

The present invention relates to a swimming goggles buckle, and more particularly to a swimming goggles buckle that allows users to adjust the length of a goggles head strap by one hand.

2. Description of the Related Art

Swimming is one of the best forms of exercise, not only shaping up one's physique, but also giving terrific fun. A pair of swimming goggles is an important accessory for this exercise, and the swimming goggles should have the easy-to-wear and free-of-leakage features, and the head strap of the swimming goggles should be adjustable conveniently.

With reference to FIG. 1 for a pair of conventional swimming goggles, the pair of swimming goggles 1 includes a latch slot 11 formed separately on external ends of two swimming goggles frames, and an elastic head strap 17 having a latch 12 formed separately at both ends of the head strap 17 and latched into the latch slot 11 of the corresponding swimming goggles frame, such that the swimming goggles can be worn on a wearer's head, wherein the latch 12 has a rectangular external frame body 13, an arc pawl 14 formed at an end of the external frame body 13, a first pillar 15 and a second pillar 16 disposed equidistantly on an internal side of the external frame body 13 and provided for dividing the external frame body 13 into three long holes, and an end of the head strap 17 is passed into a distal hole at an end of the external frame body 13 and then passed into another distal hole at another end of the external frame body 13, and then bent and passed out from a middle hole, and then passed in an opposite direction out from the same side of the original distal hole, such that the elastic head strap 17 is wound on the latch for several times for its fixation. Since the elastic head strap 17 may become loosened or elastically exhausted after a number of repeated uses of wearing on the wearer's head, it is necessary to adjust and tighten the elastic head strap 17 from time to time. For some other reasons, users may need to loosen the elastic head strap 17, but the conventional adjusting structure generally comes with an adjusting device disposed separately on both left and right sides of the head strap 17, and thus users usually cannot operate the adjusting structure by one hand. Users have to keep their head above water first and then remove the swimming goggles 1 to make adjustments on both sides of the head strap 17 by their hands. The users generally cannot make the adjustment to a fixed position at one time, but have to repeat the action of wearing the swimming goggles until an appropriate adjustment is made. Furthermore, the pawl 14 is used for latching, but its clamping force is insufficient, so that the head strap 17 may fall out easily due to improper pulling forces.

SUMMARY OF THE INVENTION

Therefore, it is a primary objective of the invention to provide a swimming goggles buckle that allows users to adjust the length of a goggles head strap by one hand.

To achieve the foregoing objective, the present invention provides a swimming goggles buckle for latching a head strap and a pair of swimming goggles, and the head strap includes a plurality of protruding strips, and the swimming goggles buckle includes a fastener and a retaining component. The fastener includes a plurality of connecting legs, a pivot portion and an elastic plate. The connecting legs are provided for latching the swimming goggles. The pivot portion is disposed at the middle of the fastener. The elastic plate is installed on a side of the fastener. The retaining component includes a shaft, a latching portion and a press portion. The shaft is pivotally installed in the pivot portion. The latching portion is disposed on a side of the shaft, and the latching portion corresponds to the protruding strips. The press portion is disposed on another side of the shaft, and the press portion corresponds to the elastic plate.

The fastener includes a bottom wall, and the elastic plate is bent and extended in a direction from a side of the bottom wall towards the press portion.

The elastic plate abuts the press portion, such that the latching portion is latched to the protruding strip.

If the press portion is pressed in a direction towards the elastic plate, the latching portion will be separated from the protruding strip.

The press portion includes a plurality of grooves.

The pivot portion is a shaft hole.

The pair of swimming goggles includes a frame body and two lens carriers, and the frame body includes two circular embedding slots, and each of the lens carriers is disposed at a position corresponding to the circular embedding slot, and each of the lens carriers includes a latch portion provided for latching the fastener thereon.

The connecting legs are installed at four corners of the fastener respectively, and the latch portion is a rectangular slot, and a protruding member is installed separately on four corners for latching the connecting legs thereon.

DETAILED DESCRIPTION OF THE PREFERRED EMBODIMENTS

To make it easier for our examiner to understand the technical contents of the present invention, preferred embodiments together with related drawings are used for the detailed description of the present invention as follows.

Figure 1:
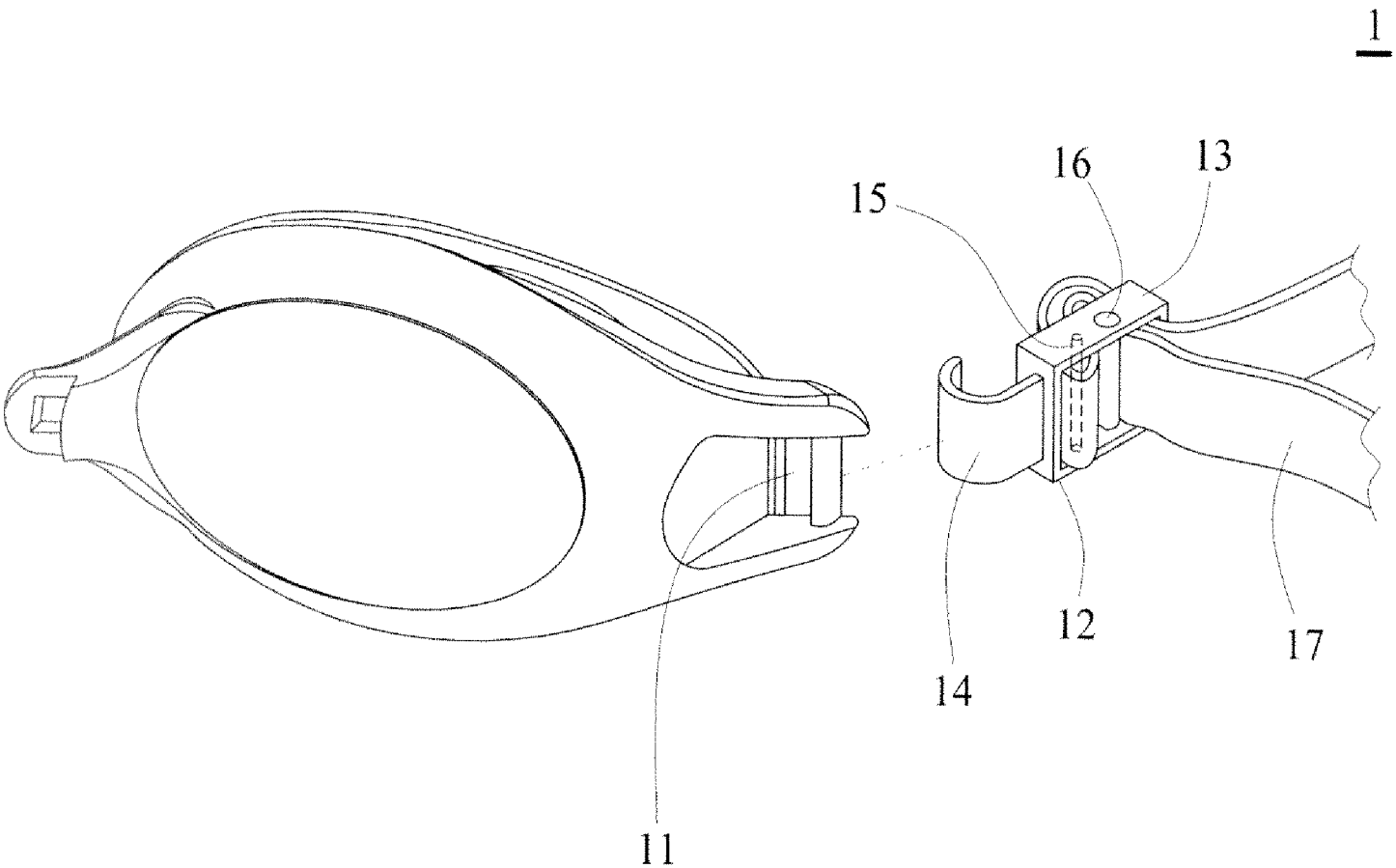
Fig.1(PRIOR ART)
FIG. 1 is a schematic view of a pair of conventional swimming goggles.
Figure 2:
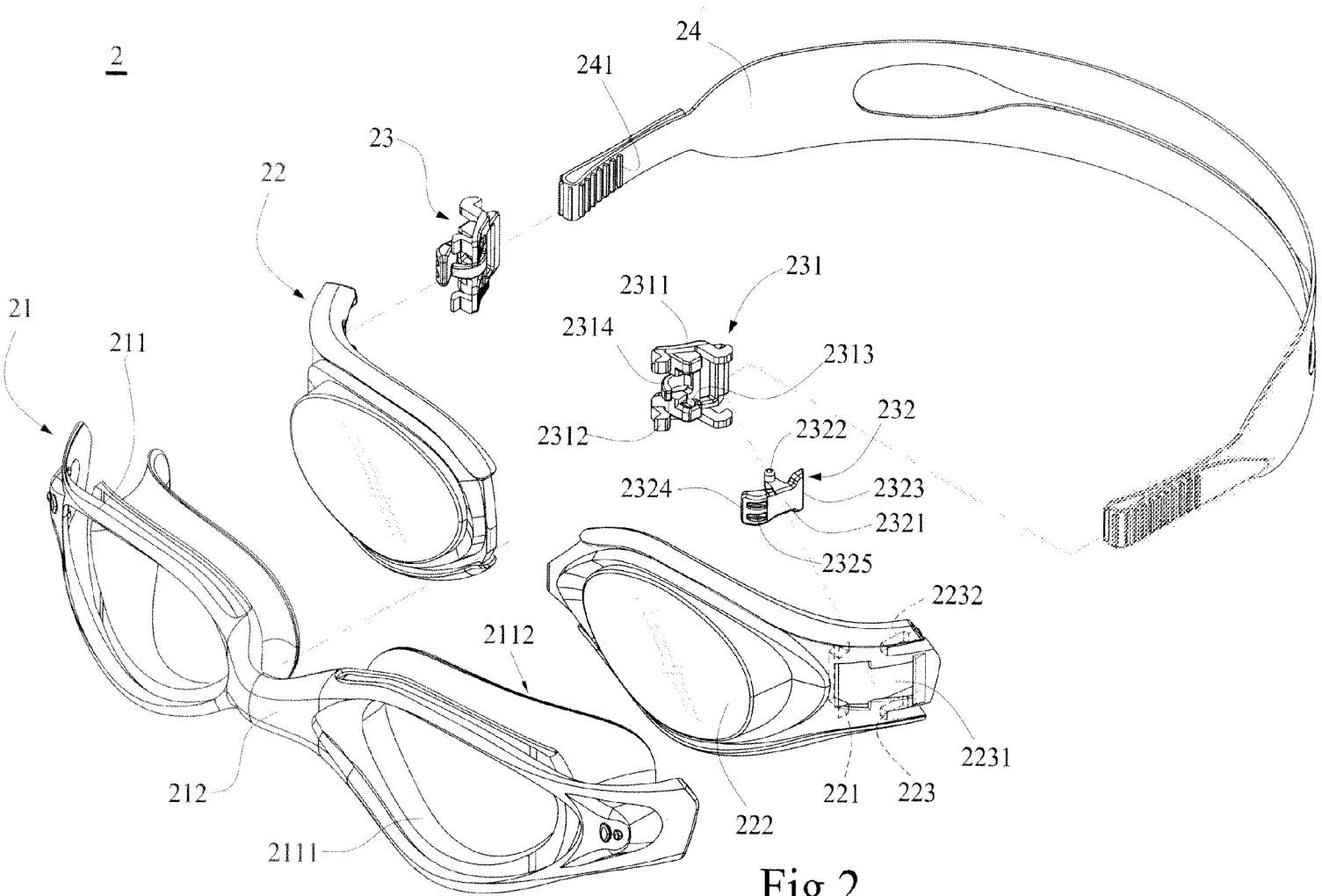
FIG. 2 is an exploded view of a swimming goggles buckle applied to a pair of swimming goggles in accordance with a preferred embodiment of the present invention.
Figure 3:
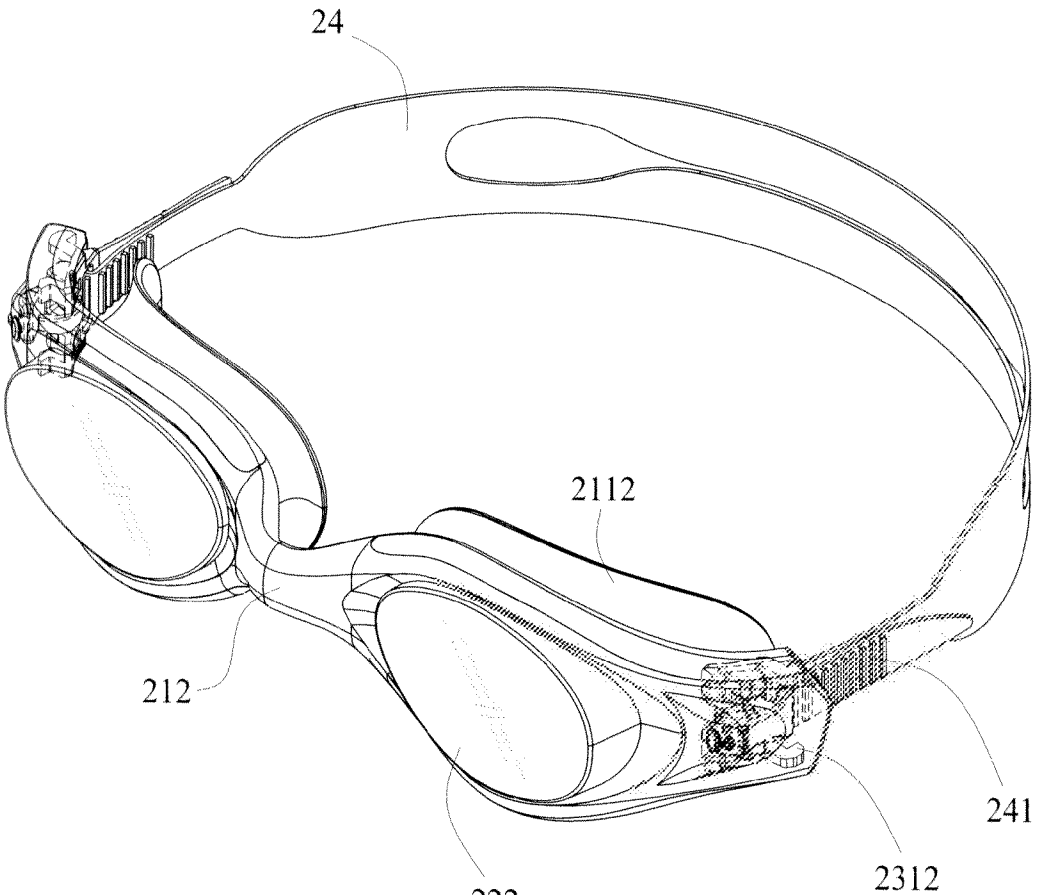
FIG. 3 is a perspective view of a swimming goggles buckle applied to a pair of swimming goggles in accordance with a preferred embodiment of the present invention.
Figure 4:
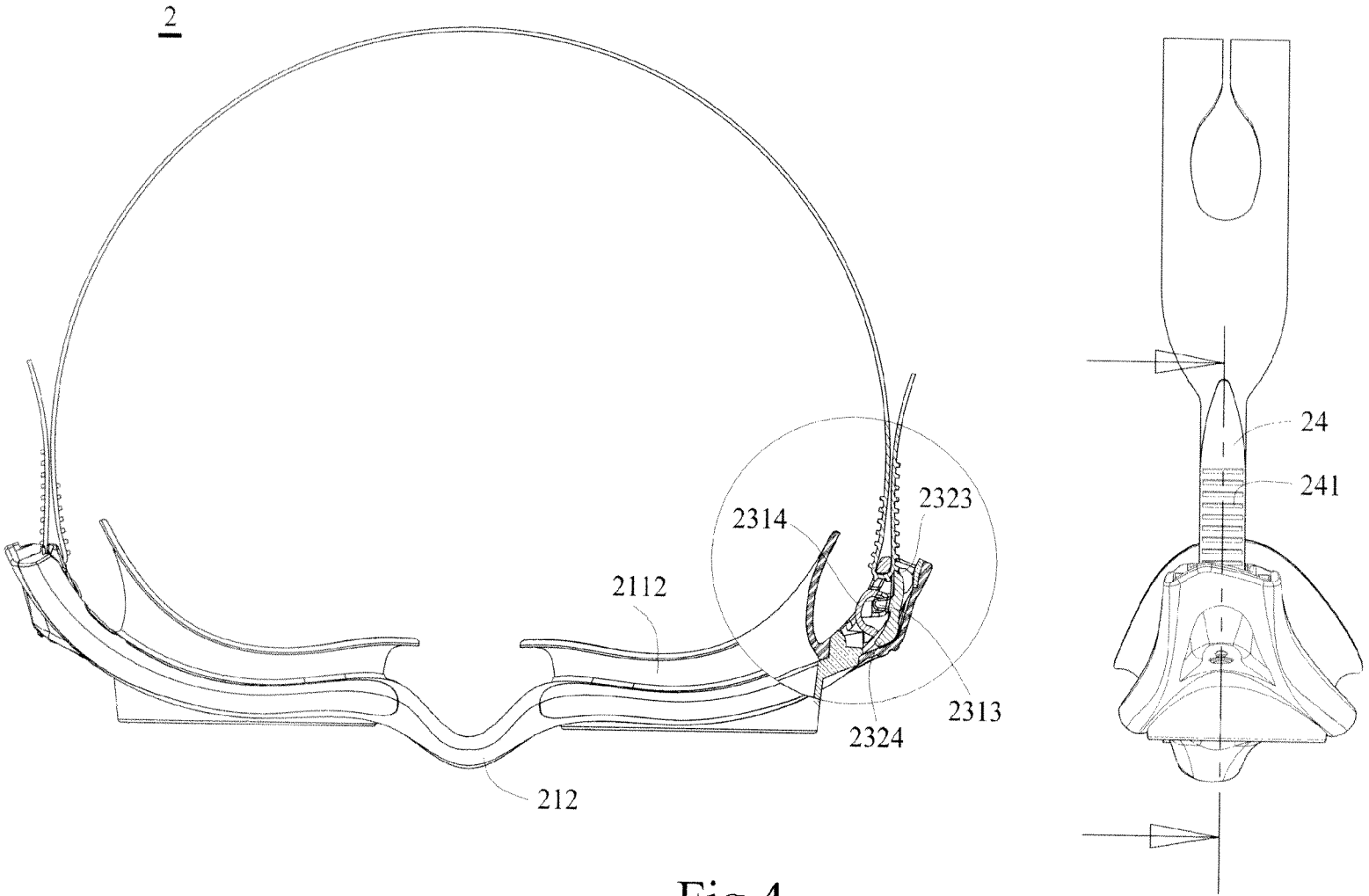
FIG. 4 is a top view of a swimming goggles buckle applied to a pair of swimming goggles in accordance with a preferred embodiment of the present invention.

With reference to FIGS. 2 to 4 for an exploded view, a perspective view and a top view of a swimming goggles buckle applied to a pair of swimming goggles in accordance with a preferred embodiment of the present invention respectively, the pair of swimming goggles 2 comprises a frame body 21, two lens carriers 22, two swimming goggles buckles 23 and a head strap 24.

The head strap 24 is made of soft rubber with a high elasticity, and the head strap 24 is a long strap with a specific thickness, and the head strap 24 includes a plurality of protruding strips 241 formed thereon.

The frame body 21 is comprised of two frames 211, wherein the frames 211 are coupled with each other by a connecting portion 212. The connecting portion 212 is made of rubber with high softness and flexibility and provided for wearing on a user's nose. Each of the frames 211 includes a circular embedding slot 2111 and an eye cover portion 2112. The eye cover portion 2112 is extended slantingly in a direction from the external periphery of the circular embedding slot 2111 on a side of the frame towards the lens carrier 22. The eye cover portion 2112 can be made of a soft material (such as silicone or high-density sponge) and provided for a direct contact with the user's skin to achieve the effect of isolating water.

The lens carrier 22 includes a carrier 221, a lens 222 and a latch portion 223. The carrier 221 can be made of a transparent plastic or acrylic material. The lens 222 is protruded outwardly from a side of the carrier 221, and the lens 222 and the carrier 221 are integrally funned. The latch portion 223 is formed on another side of the carrier 221, and the latch portion 223 includes a rectangular slot 2231 formed thereon and a protruding member 2232 installed separately at four corners of the latch portion 223.

When the lens carrier 22 is installed on the frame body 21, the lens 222 is embedded into the circular embedding slot 2111 to combine the lens carriers 22 with the frame body 21.

Figure 5:
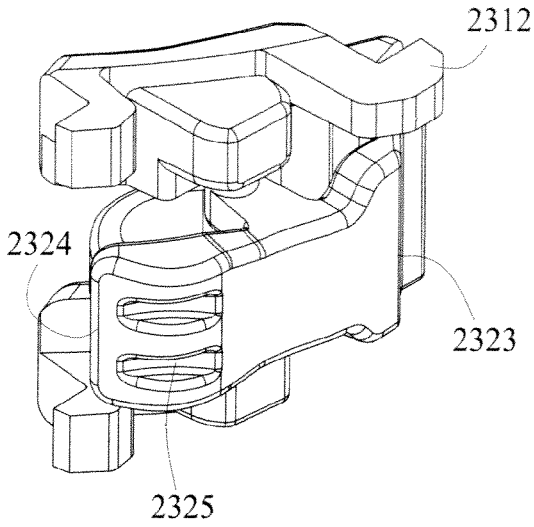
FIG. 5 is a perspective view of a swimming goggles buckle in accordance with a preferred embodiment of the present invention.
Figure 6:
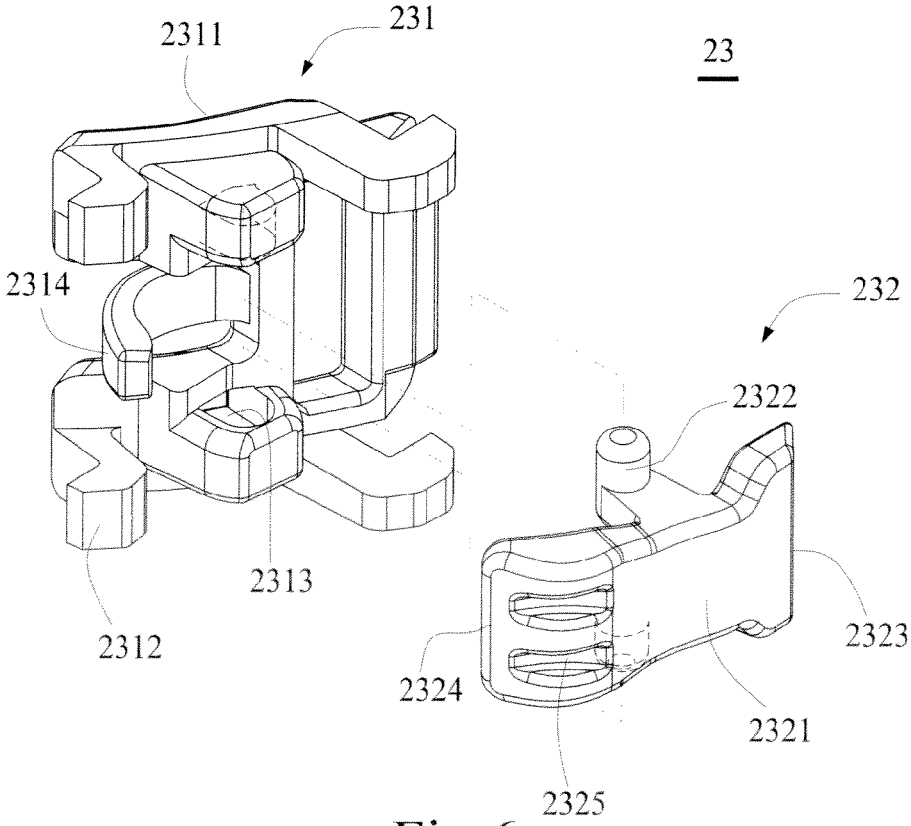
FIG. 6 is an exploded view of a swimming goggles buckle in accordance with a preferred embodiment of the present invention.

With reference to FIGS. 5 and 6 for a perspective view and an exploded view of a swimming goggles buckle in accordance with a preferred embodiment of the present invention respectively, the swimming goggles buckle 23 comprises a fastener 231 and a retaining component 232. The fastener 231 includes a bottom wall 2311, a plurality of connecting legs 2312, a pivot portion 2313 and an elastic plate 2314.

The connecting legs 2312 are bent and extended outwardly from four corners of the bottom wall 311 respectively and each connecting leg 2312 is substantially in the shape of a hook. The pivot portion 2313 is formed at the middle of the bottom wall 2311. The pivot portion 2313 is a shaft hole. The elastic plate 2314 is installed on a side of the bottom wall 2311 and bent and extended outwardly.

The retaining component 232 is installed on a side of the fastener 231, and the retaining component 232 includes a base wall 2321, a shaft 2322, a latching portion 2323 and a press portion 2324. The shaft 2322 is protruded outwardly from the middle of the base wall 2321 and pivotally installed into the pivot portion 2313. The latching portion 2323 is formed at an end of the base wall 2321 and disposed on a side of the shaft 2322, and the latching portion 2323 corresponds to the protruding strips 241 of the strap 24. The press portion 2324 includes a plurality of grooves 2325 formed thereon for facilitating users to press and operate the press portion 2324.

When the swimming goggles buckle 23 is installed on the swimming goggles 2, the connecting legs 2312 of the fastener 231 are latched onto the protruding members 2232 corresponding to the latch portion 223 for combining the swimming goggles buckle 23 and the swimming goggles 2. In addition, the head strap 24 is passed between the fastener 231 and the retaining component 232 to complete the installation of the swimming goggles.

Figure 7:
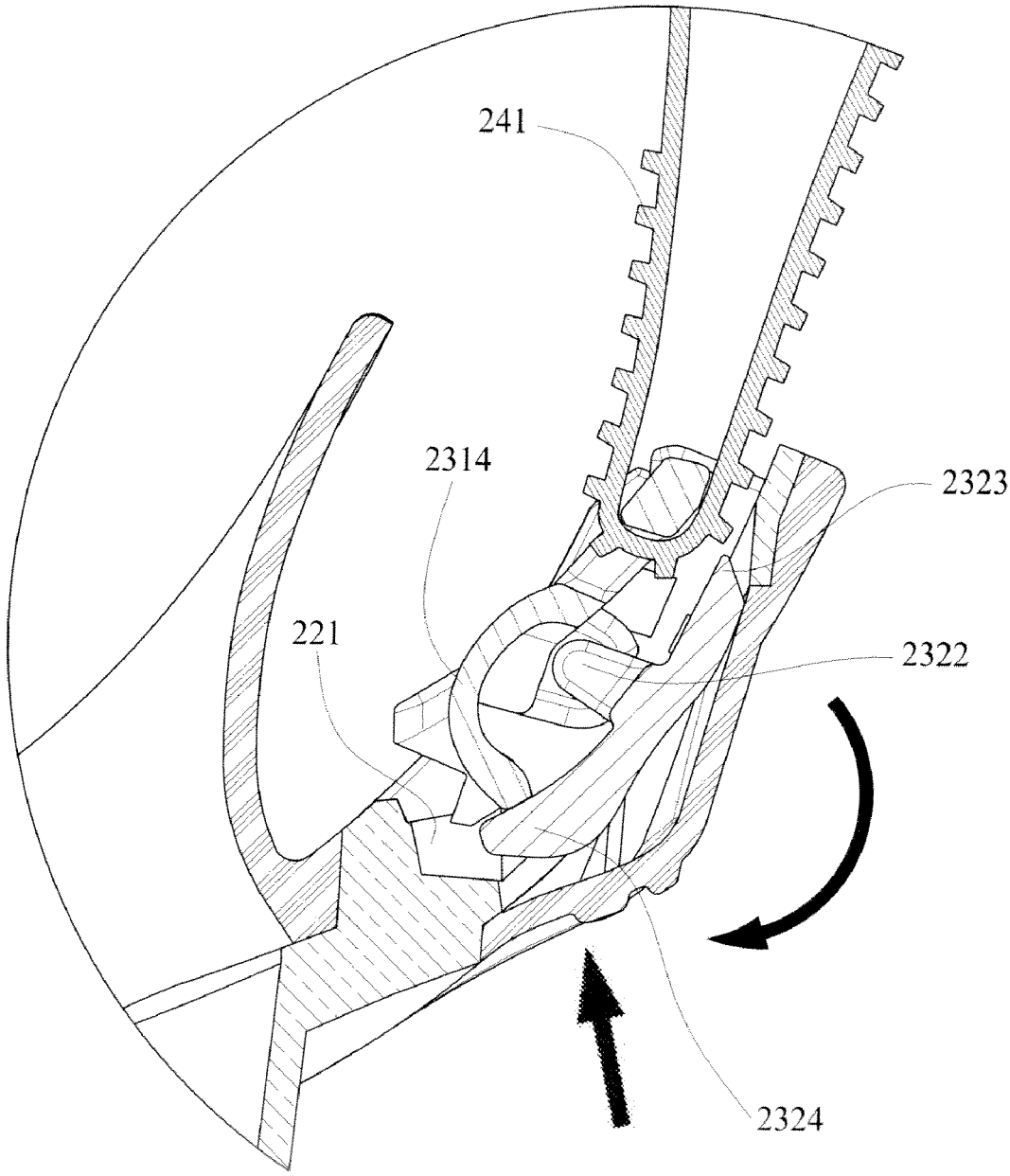
FIG. 7 is a schematic view showing a first movement of a swimming goggles buckle in accordance with the present invention.
Figure 8:
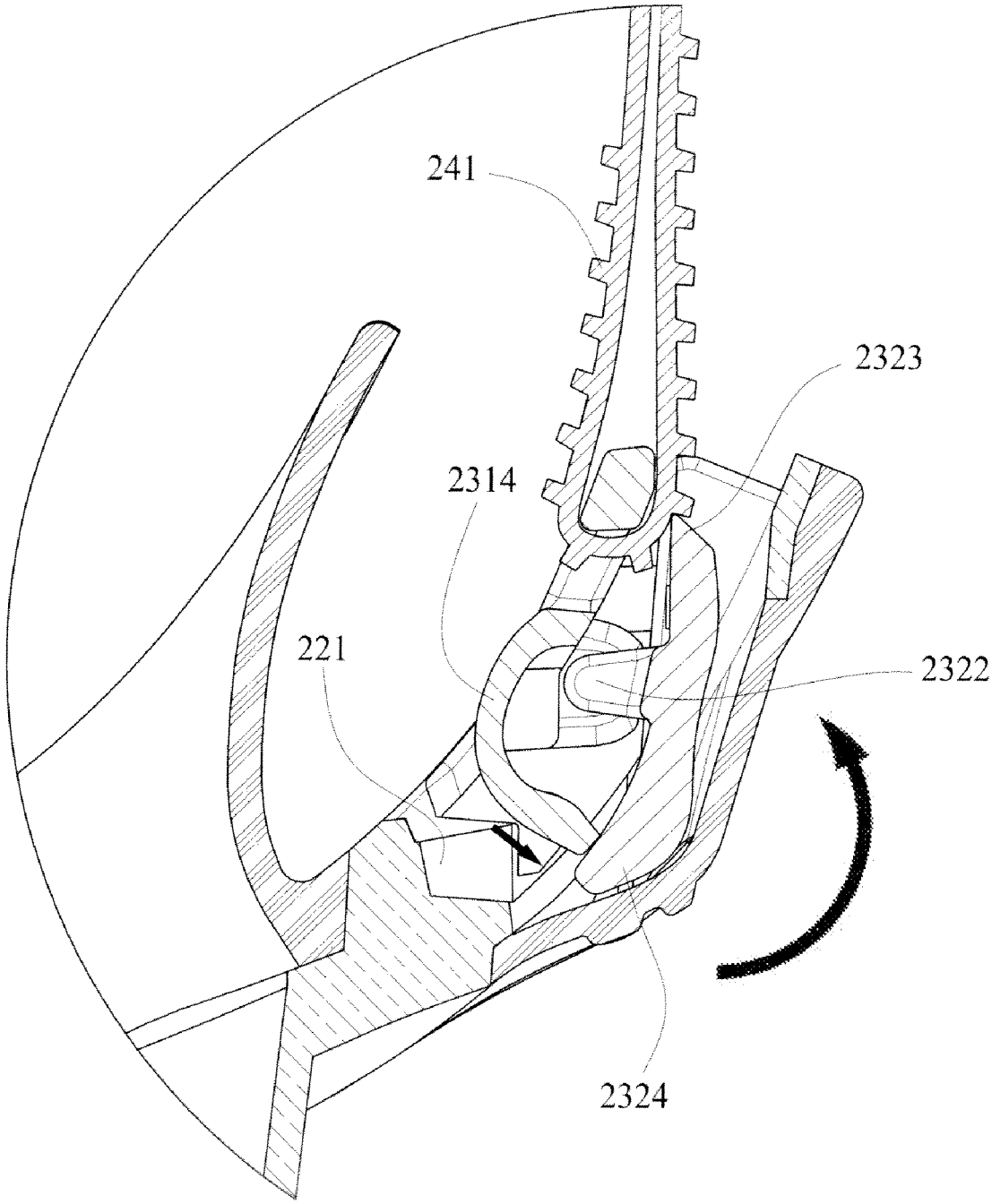
FIG. 8 is a schematic view showing a second movement of a swimming goggles buckle in accordance with the present invention.

With reference to FIGS. 7 and 8 for schematic views of first and second motions of the swimming goggles buckle in accordance with the present invention respectively, if a user wants to adjust the wearing length of the head strap 24, the user simply presses the press portion 2324 by one hand, such that the press portion 2324 presses the elastic plate 2314 to displace downward. Now, the latching portion 2323 is rotated by using the shaft 2322 as a fulcrum of a lever movement, and tilted in a direction away from the protruding strip 241 and separated from the protruding strip 241, so that the user can pull the head strap 24 to adjust the wearing length of the head strap 24.

After the user has completed the adjustment, the user just needs to release the press portion 2324. Now, the elastic plate 2314 resumes its original position by the elastic resilience and presses the press portion 2324 to displace upward, such that the latching portion 2323 is displaced in a direction towards the protruding strip 241 by the lever principle, and the position of the head strap 24 is limited again to prevent the adjusted head strap 24 from getting loosened or failing to wear on the user's head.

In summation of the description above, the swimming goggles buckle of the present invention facilitates users to adjust the length of the head strap by one hand conveniently. Obviously, the present invention improves over the prior art and complies with the patent application requirements, and thus the invention is duly filed for patent application. While the invention has been described by device of specific embodiments, numerous modifications and variations could be made thereto by those generally skilled in the art without departing from the scope and spirit of the invention set forth in the claims.

What is claimed is:

1. A swimming goggles buckle, provided for latching a head strap and a pair of swimming goggles, and the head strap having a plurality of protruding strips, and the swimming goggles buckle comprising:

a fastener, including:

a plurality of connecting legs, for latching the swimming goggles;

a pivot portion, disposed at the middle of the fastener; and an elastic plate, installed on a side of the fastener; and a retaining component, including:

a shaft, pivotally installed in the pivot portion;

a latching portion, disposed on a side of the shaft, and corresponding to the protruding strips; and a press portion, disposed on another side of the shaft, and corresponding to the elastic plate.

2. The swimming goggles buckle of claim 1, wherein the fastener includes a bottom wall, and the elastic plate is bent and extended in a direction from a side of the bottom wall towards the press portion.

3. The swimming goggles buckle of claim 2, wherein the elastic plate abuts the press portion, such that the latching portion is latched to the protruding strip.

4. The swimming goggles buckle of claim 3, wherein the latching portion is separated from the protruding strip when the press portion is pressed in a direction towards the elastic plate.

5. The swimming goggles buckle of claim 4, wherein the press portion includes a plurality of grooves.

6. The swimming goggles buckle of claim 1, wherein the pivot portion is a shaft hole.

7. The swimming goggles buckle of claim 5, wherein the pair of swimming goggles includes a frame body and two lens carriers, and the frame body includes two circular embedding slots, and each of the lens carriers is installed at a position corresponding to the circular embedding slot, and each of the lens carriers includes a latch portion for latching the fastener thereon.

8. The swimming goggles buckle of claim 7, wherein the connecting legs are installed at four corners of the fastener respectively, and the latch portion is a rectangular slot having a protruding member installed separately at the four corners for latching the connecting legs thereon respectively.

* * * * *